US005261558A

United States Patent [19]

Claydon

[11] Patent Number: 5,261,558

[45] Date of Patent: Nov. 16, 1993

[54] CAN BODIES

[75] Inventor: Paul C. Claydon, Wantage, United Kingdom

[73] Assignee: CarnaudMetalbox PLC, United Kingdom

[21] Appl. No.: 993,972

[22] Filed: Dec. 17, 1992

Related U.S. Application Data

[63] Continuation of Ser. No. 806,509, Dec. 13, 1991, abandoned.

[30] Foreign Application Priority Data

Dec. 21, 1990 [GB] United Kingdom ..... 9027851

[51] Int. Cl.[5] ..... B65D 8/00

[52] U.S. Cl. ..... 220/671; 220/906

[58] Field of Search ..... 220/671, 906

[56] References Cited

U.S. PATENT DOCUMENTS

| | | | |
|---|---|---|---|
| D. 283,011 | 3/1986 | Moloney et al. . | |
| D. 290,688 | 7/1987 | Moloney et al. . | |
| D. 306,972 | 4/1990 | Moloney et al. . | |
| 1,378,442 | 5/1921 | Chalfant . | |
| 1,454,802 | 5/1923 | Wells | 220/671 |
| 2,063,013 | 12/1936 | Cooper | 220/906 X |
| 3,317,110 | 5/1967 | Palmer | 220/671 X |
| 3,335,902 | 8/1967 | Javorik . | |
| 3,402,871 | 9/1968 | Palmer | 220/671 X |
| 4,169,537 | 10/1979 | Sabreen . | |
| 4,512,490 | 4/1985 | Frei et al. . | |
| 4,578,976 | 4/1986 | Shulski et al. . | |
| 4,723,681 | 2/1988 | Glerum | 220/671 |
| 4,953,738 | 9/1990 | Stirbis | 220/906 X |
| 5,040,698 | 8/1991 | Ramsey et al. . | |

FOREIGN PATENT DOCUMENTS

| | | |
|---|---|---|
| 2505688 | 5/1982 | France . |
| WO87/02282 | 4/1987 | PCT Int'l Appl. . |
| WO91/11275 | 8/1991 | PCT Int'l Appl. . |
| 236059 | 8/1924 | United Kingdom . |
| 243947 | 2/1925 | United Kingdom . |
| 703836 | 12/1948 | United Kingdom . |
| 1120576 | 7/1966 | United Kingdom . |
| 1022336 | 9/1984 | United Kingdom . |

*Primary Examiner*—Steven M. Pollard

*Attorney, Agent, or Firm*—Diller, Ramik & Wight

[57] ABSTRACT

A metal can body for a beverage can comprises a bottom end wall 2 and a generally cylindrical side wall 3; the side wall comprising a bottom portion 4 connected to the bottom wall, a central portion 5 extending upwardly from the bottom portion, and a top portion 6 extending upwardly from the central portion and terminating in an open end. The top portion 6 and bottom portion 4 are of greater wall thickness than the central portion 5 and are respectively connected to the central portion through upper and lower annular zones 7, 8 of reducing wall thickness. The side wall is provided with a plurality of parallel externally convex longitudinal ribs 10 equally spaced around the circumference and terminating within the zones 7, 8 of reducing wall thickness.

5 Claims, 4 Drawing Sheets

CAN BODIES

This application is a continuation of application Ser. No. 07/806,509, filed Dec. 13, 1991, now abandoned.

BACKGROUND OF THE INVENTION

1. Field of the Invention

The invention relates to metal can bodies for beverage cans. Such can bodies are adapted to be closed by a can end seamed to the open end of the can body to form a closed can.

2. Description of the Prior Art

Known can bodies for beverage cans comprise a bottom end wall and a generally cylindrical side wall; the side wall comprising a bottom portion connected to the bottom wall, a central portion extending upwardly from the bottom portion, and a top portion extending upwardly from the central portion and terminating in an open end; wherein the top portion and bottom portion are of greater wall thickness than the central portion and are respectively connected to the central portion through upper and lower annular zones of reducing wall thickness.

SUMMARY OF THE INVENTION

During handling of can bodies small dents may be made in the cylindrical wall and these dents provide localised points of weakness which can lead to creasing during necking and flanging of the neck of the can body, and filling double seaming of the can end onto the can body during which the can body is subjected to an axial load. It has been found that the provision of a plurality of parallel longitudinally extending outwardly convex ribs in the central portion of the can body will reduce or eliminate the effect of such dents and give axial strength to the can. It has also been found that the optimum performance of the can body is achieved when the ribs terminate in the zones of reducing wall thickness and thus connect the portions of greater wall thickness together.

Accordingly the invention provides a metal can body for a beverage can comprising a bottom end wall and a generally cylindrical side wall; the side wall comprising a bottom portion connected to the bottom wall, a central portion extending upwardly from the bottom portion, and a top portion extending upwardly from the central portion and terminating in an open end; wherein the top portion and bottom portion are of greater wall thickness than the central portion and are respectively connected to the central portion through upper and lower annular zones of reducing wall thickness; and wherein the side wall is provided with a plurality of parallel externally convex longitudinal ribs equally spaced around the circumference and terminating within the zones of reducing wall thickness.

DESCRIPTION OF THE PREFERRED EMBODIMENTS

Figure 2:
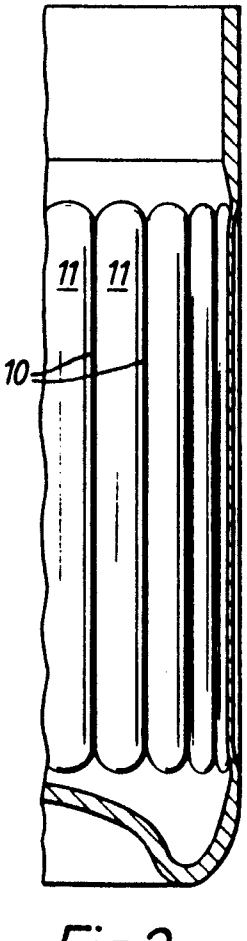
FIG. 2 shows a partial section of a can body after provision of the longitudinal ribs.
Figure 1:
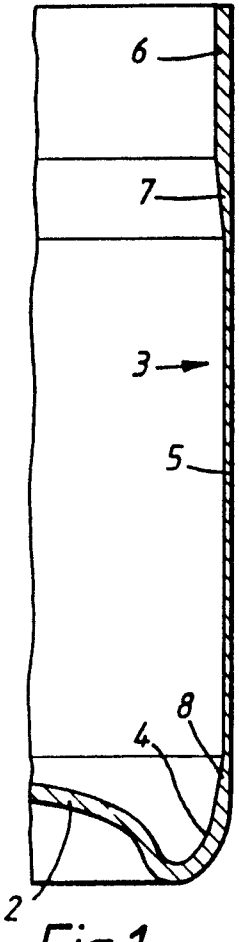
FIG. 1 shows a partial section of a can body prior to provision of the longitudinal ribs.

Referring to FIGS. 1–4 it will be seen that the can body 1 comprises a bottom end wall 2, which in this case is domed, and a side wall 3. The side wall 3 comprises a bottom portion 4 connected to the bottom end wall, a central portion 5 and a top portion 6 terminating in an open end. The top portion 6 and bottom portion 4 are of greater wall thickness than the central portion 5 and are respectively connected to the central portion 5 through upper and lower annular zones 7, 8 which have a wall thickness which reduces towards the central portion 5. Typically the wall thickness of the top portion will be about 0.15 mm (0.0060 inches), central portion about 0.1 mm (0.0040 inches), and bottom portion about 0.3 mm (0.0120 inches). The can body of FIG. 1 is formed by blanking a disc from sheet metal, drawing a cup from the disc to form a bottom end wall and a side wall, and wall ironing the side wall. FIG. 2 shows the can body after the provision of a plurality of parallel longitudinally extending convex ribs 10 equally spaced around the circumference. The ribs 10 terminate in the zones 7, 8. Adjacent ribs define elongate panels 11 therebeteween. Each panel 11 has semi-elliptical shaped end areas formed within the zones 7,8. The ribs and panels extend into the zones 7,8 to optimize the can body performance by providing strengthening columns connecting the upper and lower portions 4, 6 of relatively great wall thickness.

Figure 3:
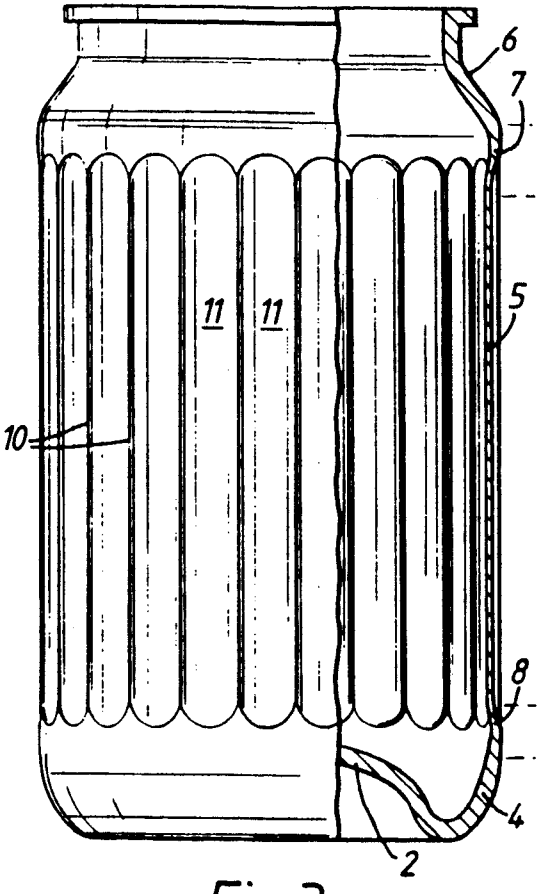
FIG. 3 shows a side view of a can body, partially in section after provision of the ribs and after necking and flanging.

FIG. 3 shows the can body after necking and flanging of the top portion 6 in readiness for receiving a can end to be seamed to the flange 12 in known manner.

Figure 4:
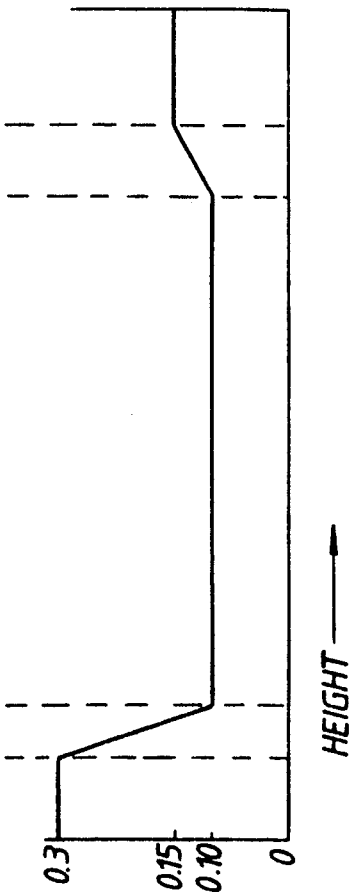
FIG. 4 is a graph representing the wall thickness of the can body of FIG. 3 against height.

FIG. 4 shows the thickness profile of the side wall as it varies through the height of the can body.

FIGS. 1–4 show a can body provided with only 24 ribs 10 and panels 11. It is believed that can bodies having from about 24 to about 45 ribs are useful for beverage cans. If the number of ribs is less than about 24 there is a significant reduction in the volume of the finished can.

Figure 5:
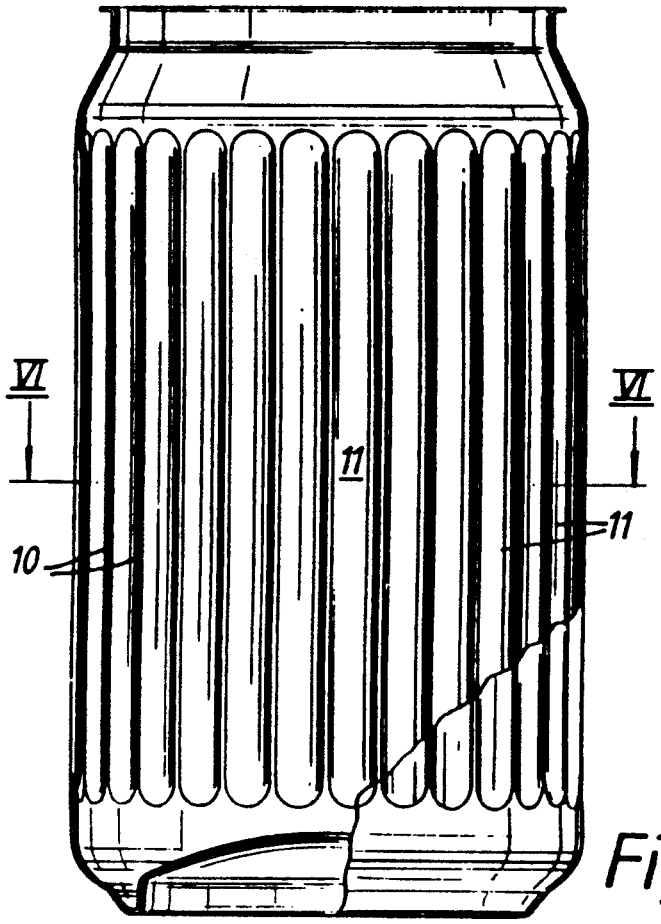
FIG. 5 is a side view of a can body.
Figure 6:
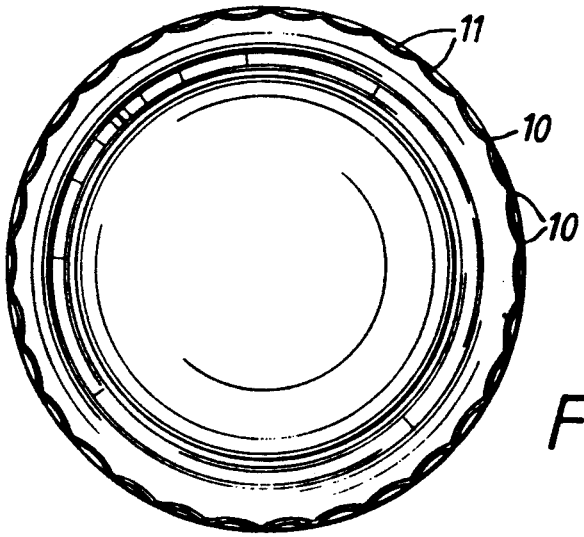
FIG. 6 is a horizontal section of the can body of FIG. 5 taken on lines VI—VI.

FIGS. 5 and 6 show a can body having 30 ribs 10 and panels 11. Each rib is outwardly convex having a radius P and lies on a circle of radius R where R is the radius of the can body in the middle of the central portion prior to formation of the ribs. The panels 11 are outwardly concave and have a radius U. The concavity of the panels 11 has been exaggerated in FIGS. 5 and 6. The ratio of U:P is preferably at least 20:1. Typically the rib radius P will be about 1 mm. The perimeter of the can body in the central portion after forming of the ribs is the same as it was beforehand and the radii R, P and U are related by the equation $R=U+2P$. In this manner, stretching of the can wall during form of the ribs is avoided.

Figure 7:
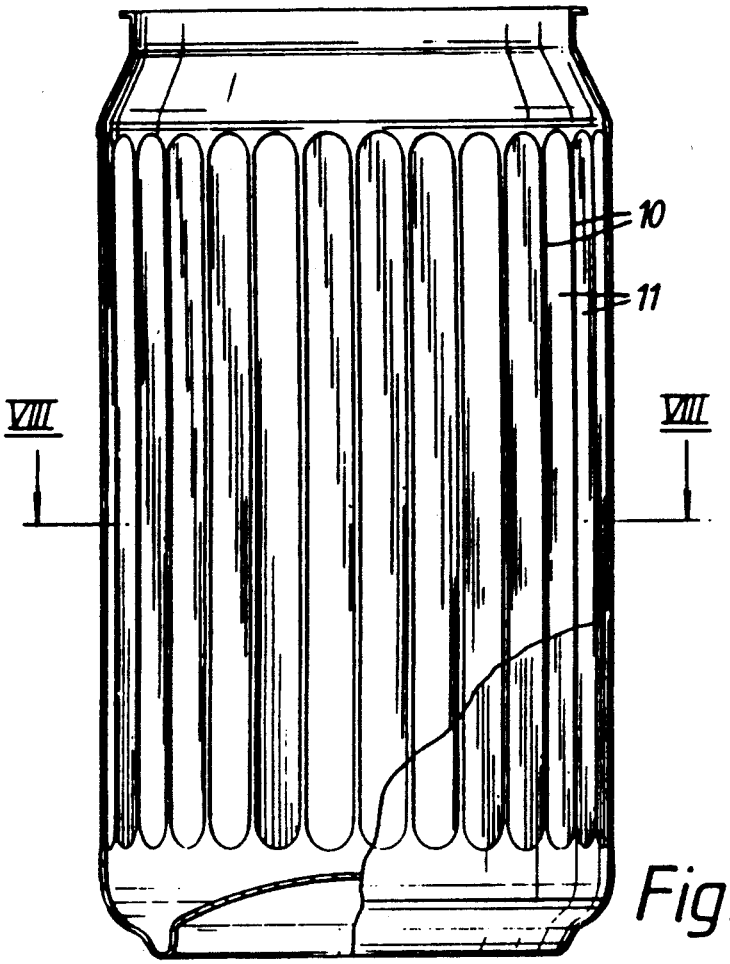
FIGS. 7 and 8 are similar views to those of FIGS. 5 and 6 of an alternative embodiment of can body.
Figure 8:
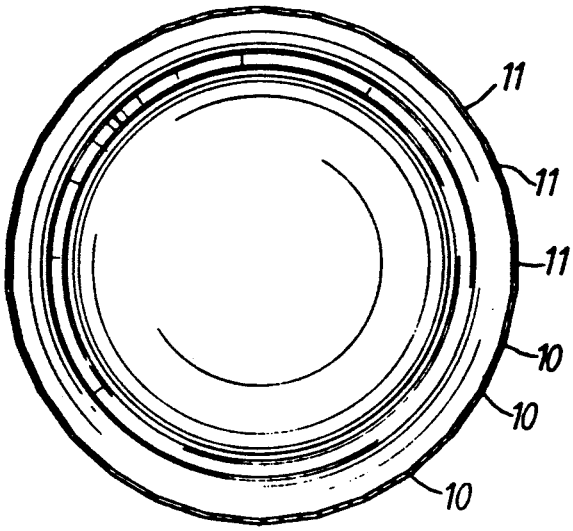

In a further embodiment shown also in FIGS. 7 and 8, also having 30 ribs 10, the panels are substantially flat. In this case the ribs 10 will lie on a circle whose radius is very slightly greater than the radius R prior to formation of the ribs and panels. As a result of the wall ironing process for forming the can body, however, the top and bottom portions 6 and 4 have a slightly greater radius than the central portion and the radius of the central portion of the can body after formation of the ribs will be no greater than the radius of the top and bottom portions. This is important in handling since the can body must roll truly.

Figure 9:
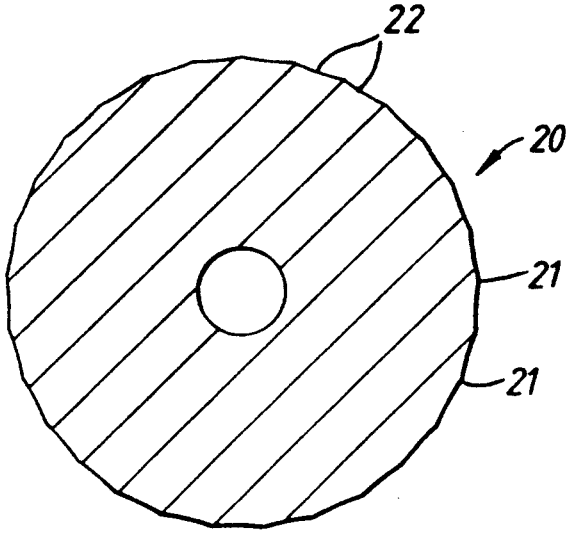
FIG. 9 is a radial cross section through a mandrel for forming ribs in a can body.
Figure 10:
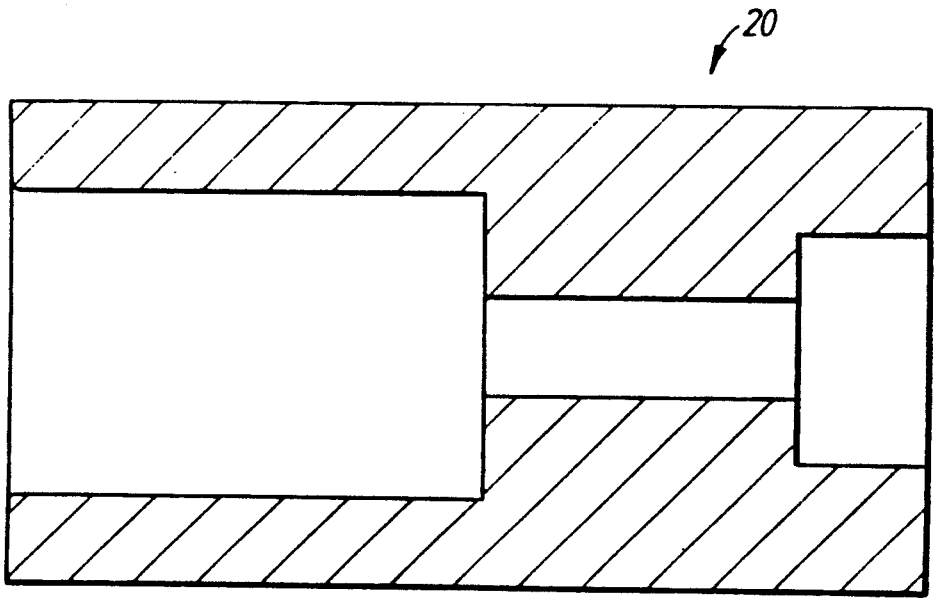
FIG. 10 is an axial section through a mandrel for forming a can body.

FIGS. 9 and 10 show a mandrel 20 used in formation of the ribs and panels. The can body is located over the mandrel which is then rolled along an external forming rail (not shown). The ribs are formed prior to necking of the can body but nevertheless the mandrel must be of smaller radius than the can body so that it can be extracted from the can body. To this end it is formed with less ribs than the can body. In the example shown the mandrel 20 has 29 ribs 21 for forming a can body with 30 ribs. Between the ribs 21 on the mandrel are panels 22 which are outwardly concave. The profiles of the panels 22 will determine the profiles of the panels 11 in the can body. The mandrel shown in FIGS. 9 and 10 is for forming the can body of FIGS. 7 and 8 having substantially flat panels 11. During formation, the side wall of the central portion of the can body is locally deformed to the profile of the mandrel 20 but due to the natural resilience of the material the panels of the can body will subsequently spring back to a substantially flat profile. If a can body as shown in FIGS. 5 and 6 is required, the panels 22 of the mandrel 20 are formed more deeply concave. The depth of the panel must, however, be relatively shallow to avoid excessive loss of volume and to prevent the panels from reversing when subjected to internal pressure as would be experienced when the can is filled with a carbonated drink.

The improved performance of can bodies as a result of the panelling may be used to increase the axial load strength, or to allow a reduction of the wall thickness of the central portion 5 without loss of axial strength. Comparative tests have shown that the performance of panelled can bodies having a wall thickness in the central portion of $40\times10^{-4}$ inches is comparable to that of unpanelled can bodies of wall thickness $43\times10^{-4}$ inches. Considering the large number of can bodies made, this represents a very significant saving.

I claim:

1. A drawn metal can body for a beverage can comprising a bottom end wall and a generally cylindrical side wall; the generally cylindrical side wall including a bottom portion connected to the bottom end wall, a central portion extending upwardly from the bottom portion, and a top portion extending upwardly from the central portion and terminating in an open end; wherein the top portion and bottom portion are each of a peripherally continuous configuration and are of greater wall thickness than the central portion and are respectively connected to the central portion through upper and lower drawn annular zones of substantial reducing wall thickness which reduce in an axial direction toward each other; said generally cylindrical side wall is provided with a plurality of parallel externally convex longitudinal ribs equally spaced around the circumference and terminating at opposite rib ends lying within and terminating within the drawn annular zones of substantial reducing wall thickness; an elongated panel between adjacent longitudinal ribs, each elongated panel having oppositely disposed semi-elliptical shaped end portions, and said semi-elliptical shaped end portions lie within and terminate within the drawn annular zones of substantial reducing wall thickness.

2. A metal can body as claimed in claim 1 wherein the elongated panels are outwardly concave.

3. A metal can body as claimed in claim 1 wherein the elongated panels are substantially flat.

4. A metal can body as claimed in claim 1 wherein the number of panels is from 24 to 45.

5. A metal can body as claimed in claim 4 wherein the number of panel is about 30.

* * * * *